US008636965B2

(12) United States Patent
Lohn

(10) Patent No.: US 8,636,965 B2
(45) Date of Patent: Jan. 28, 2014

(54) MICROTITATION PLATE

(75) Inventor: Jurgen Lohn, Klein Meckelsen (DE)

(73) Assignee: Eppendorf AG, Hamburg (DE)

( * ) Notice: Subject to any disclaimer, the term of this patent is extended or adjusted under 35 U.S.C. 154(b) by 940 days.

(21) Appl. No.: 11/194,866

(22) Filed: Aug. 1, 2005

(65) Prior Publication Data

US 2006/0120927 A1 Jun. 8, 2006

(30) Foreign Application Priority Data

Dec. 6, 2004 (DE) ..... 20 2004 018 921 U

(51) Int. Cl.
*B01L 3/00* (2006.01)

(52) U.S. Cl.
USPC ..... 422/553; 422/547; 422/551; 422/552

(58) Field of Classification Search
USPC ..... 422/102, 547, 551, 552, 553
See application file for complete search history.

(56) References Cited

U.S. PATENT DOCUMENTS 4,207,102 A * 6/1980 Dessauer ..... 430/252
4,299,920 A * 11/1981 Peters ..... 435/288.4
6,340,589 B1 * 1/2002 Turner et al. ..... 435/287.2
6,575,364 B1 * 6/2003 Feygin ..... 235/449
2001/0051112 A1 12/2001 Gulzow et al.
2002/0057995 A1 5/2002 Desie et al.
2005/0221358 A1 * 10/2005 Carrillo et al. ..... 435/6

FOREIGN PATENT DOCUMENTS

WO WO 9402857 A1 * 2/1994 ..... G01N 35/02
WO WO 2005028110 A2 * 3/2005

OTHER PUBLICATIONS

SBS Recommended Microplate Specificatios, Revised Apr. 1999.*

* cited by examiner

*Primary Examiner* — Jill Warden
*Assistant Examiner* — Dwayne K Handy
(74) *Attorney, Agent, or Firm* — Vidas, Arrett & Steinkraus, P.A.

(57) ABSTRACT

A microtitration plate, comprising:

a frame which is made of at least one laser-inscribable plastic completely or in at least one area, and a multiplicity of receptacles arranged in the frame and having an opening on one side of the frame which are made of a plastic other than the laser-inscribable plastic.

18 Claims, 1 Drawing Sheet

MICROTITATION PLATE

CROSS-REFERENCE TO RELATED APPLICATIONS

Not applicable.

STATEMENT REGARDING FEDERALLY SPONSORED RESEARCH

Not applicable.

BACKGROUND OF THE INVENTION

Microtitration plates are particularly used for most varied microbiological, cell-breeding, and immunological procedures. For example, microtitration plates are employed in PCR and in breeding of microorganisms or cells. Microtitration plates are known which have a frame with a multiplicity of receptacles to receive sample liquids. The receptacles are also referred to as "wells". For example, they are formed as indentations in a frame which is plate-shaped altogether. In other designs, the frame has a plate to which the receptacles are connected. They have an opening at the upper side of the plate and project from the lower side of the plate. The frame can have a circumferential jacket which also projects from the lower side of the plate.

The current microtitration plates have 12×8=96 receptacles in rows and columns. However, microtitration plates having a larger number of receptacles, e.g. 384 receptacles, are used more and more.

Microtitration plates in the sense of this application specifically are microtitration plates in conformity with the recommendations made by the SBS (=Society for Biomolecular Screening), PCR plates, deep-well plates, culture plates, filter plates, etc.

Known microtitration plates have been provided with receptacle identifiers already to mark the receptacles. To this end, a line of numbers is arranged above the receptacles disposed in parallel rows and columns and a column of letters is arranged on the upper side of the frame on the left and/or right next to the receptacles. If the numbers and letters are merely embossed they stand out against the undersurface only at a low contrast and are poorly legible. Microtitration plates having numbers and letters printed thereon are also known. This identifier can be washed away and is not fast to light. This is also true for bar codes which are printed on and are used to identify microtitration plates. Bar codes which are pasted on can come off. Finally, it is known to mark one corner of the frame with a chamfer for a positioning of microtitration plates. Manufacturers do not apply the chamfer in a uniform way so that the user finds its more difficult to position the microtitration plate via the chamfer.

Therefore, it is the object of the invention to provide a microtitration plate which allows marking the characteristics of which are better in use.

BRIEF SUMMARY OF THE INVENTION

The inventive microtitration plate has a frame which is made of at least one laser-inscribable plastic completely or in at least one area, a multiplicity of receptacles arranged in the frame and having an opening on one side of the frame which are made of a plastic other than the laser-inscribable plastic.

The inventive microtitration plate is made of at least two plastic materials. At least one laser-inscribable plastic is used for the frame or at least one area of the frame. This can be a plastic which generally can be inscribed by a laser or becomes inscribable by a laser by admixing (an) additive(s). As a result, the frame or at least one area of the frame can be inscribed by a laser. A different plastic is used for the receptacles, that can be chosen specifically with regard to its suitability for the processes to be carried out with the microtitration plate. This is accomplished particularly under the viewpoint of avoiding undesirable interactions with samples to be filled into the receptacles. The laser-inscribable plastic has no adverse effect on the samples because it is limited to the frame. If the microtitration plate was manufactured completely from a laser-inscribable plastic it would be impossible to rule out trouble in analyzing or otherwise treating the samples by the laser-inscribable plastic or constituents thereof.

The laser-made inscription on the microtitration plate can be read even under an unfavourable angle of vision and at dim light. It can also be recognized through a thin layer of ice or white frost. It can neither be washed away nor destroyed by solvents and is fast to light. An individual laser-made inscription is possible on single microtitration plates. Further, the laser-made inscription can be applied at a high precision.

The microtitration plate can be manufactured relatively easily by a multi-component injection moulding technique. It is preferred to manufacture it by the core withdrawal technique which is more reasonably priced than are other multi-component injection moulding techniques and, more specifically, is more reasonably priced than is the conversion technique.

According to an aspect, the frame has a plate in which the receptacles are formed or to which the receptacles are connected. This includes aspects in which layers which line the receptacles are made of a plastic other than the laser-inscribable plastic. It further includes receptacles made of a different plastic which are connected to the plate merely at their upper marginal area and project beyond the lower side of the plate.

According to an aspect, for the rest, the plate is made of the laser-inscribable plastic completely or in at least one area. This specifically allows to apply the laser inscription to the upper side which is visible particularly well when the microtitration plate is used.

According to an further aspect, one area of the plate that surrounds all of the receptacles in a frame-like manner is manufactured from the laser-inscribable plastic completely or in at least one area. For example, it is possible for a user to apply a receptacle identifier and/or an individual plate identifier and/or a manufacturer's identifier and/or a user's identifier to the area which surrounds the receptacles in a frame-like manner so as to make them visible well. According to an aspect, a jacket of the frame that surrounds the plate is made of a laser-inscribable plastic completely or in at least one area. For example, an individual plate identifier can be applied to the jacket.

According to an aspect, an upper layer of the frame is made of the laser-inscribable plastic completely or in at least one area. Thus, it is possible to apply the laser-made inscription to the outside of the frame in a well-visible manner. The underlying layer of the frame can be made of a plastic which is advantageous, for example, in regard of the bond to the receptacles or in regard of stability. More specifically, this plastic can be the same plastic as the plastic for the receptacles.

According to an aspect, the receptacles, a central area of the plate that is connected to the receptacles, the jacket, and webs connecting the central area to the jacket are made of the same plastic and one area of the frame that is disposed between the central area of the plate and the jacket is made of the laser-inscribable plastic completely or at least in part. The microtitration plate configured in this fashion can be manufactured by the two-component injection moulding technique. It is suited particularly well for manufacture by the more reasonably priced core withdrawal technique.

According to an aspect, the laser-inscribable plastic is of a color other than that of areas of the frame that cannot be inscribed by a laser, and/or that of the receptacles. This allows to visually underline the laser-made inscription which makes it easier to apply and read the inscription. According to an aspect facilitating both application and readability, the microtitration plate comprises a plurality of areas made of a laser-inscribable plastic of different colors. The areas having different colors can be used for an identification of different working procedures.

It is understood that the laser-made inscription is of a color which is different from that of the laser-inscribable area having the laser-made inscription. According to an aspect which further improves the readability thereof, the laser-made inscription is of a color other than that of the areas of the frame that cannot be inscribed by a laser and/or that of the receptacles.

According to an aspect, the laser-inscribable plastic has an adhesive bond and/or a joint via counterdrafts and/or a latched joint with adjacent areas of the frame and/or receptacles. According to another aspect, the adhesive bond is made by a fusion of various plastics or a bond of various plastics via an adhesive substance. When the bond is made by the multi-component injection moulding technique the technique can be carried out in such a way that the various plastics fuse with each other at the points of contact. A joint via counterdrafts and the latched joint is beneficial, for example, for the bond between plastics between which an adhesive bond cannot be created or only an adhesive bond of a low load-bearing capacity can be established.

According to an aspect, the laser-inscribable plastic can be inscribed by a laser via a change in color and/or carbonization and/or foaming and/or erosion of material. According to a further aspect, the capability of being inscribed by a laser via a change in color is provided by a laser-inscribable plastic which comprises a basic material including a laser additive. The basic material essentially is the same as the plastic of frame areas which cannot be inscribed by a laser and/or the plastic of the receptacles. This favors an adhesive bond between the various plastics.

According to an aspect, the basic material of the laser-inscribable plastic is PP (polypropylene) or PS (polystyrene) or another thermoplastic substance or thermoplastic elastomer. It is especially receptacles manufactured from PP and PS which are suited for many uses. This makes it particularly advantageous to use them as a basic material.

According to an aspect, the plastic which is laser-inscribable by a change in color is PC (polycarbonate) or PVC (polyvinylchloride) or another plastic which can be inscribed by a laser not including laser additives. This aspect avoids admixing laser additives.

According to an aspect, the plastic of areas of the frame or that of the receptacles that cannot be inscribed by a laser is PP, PS, PC, PVC or another thermoplastic substance or thermoplastic elastomer. Receptacles in PP, PS, PC or PVC are suited for many uses. According to what was stated above they allow to be bonded beneficially to an appropriately configured basic material of the laser-inscribable plastic.

According to an aspect, the receptacles are made of a transparent plastic at least in part. The transparent plastic is advantageous, in particular, for performing visual measurements on samples in the receptacles.

According to an aspect, the microtitration plate has at least one laser-made inscription. The laser-made inscription is introduced by the manufacturer of the microtitration plate or its user, for example, in at least one laser-inscribable area.

The laser-made inscription can be configured in varied manners. According to an aspect, it is a receptacle identifier including a series of numbers and a series of letters for an identification of each receptacle of the microtitration plate and/or is a plate identifier for an identification of the entire microtitration plate and/or a manufacturer's identifier and/or position identifier to mark the orientation of the microtitration plate.

According to a further aspect, the microtitration plate has the position identifier at a corner of the frame. The position identifier can be easily placed by the manufacturer on the basis of the customer's specific requests or by the customer. According to an aspect, the numbers of the receptacle identifier exist at one side of an area of the frame that surrounds a central area of the frame in a frame-like manner and the letters of the identifier exist at a side perpendicular thereto of the area of the frame that surrounds the central area of the frame in a frame-like manner.

According to a further aspect, the plate identifier is a bar code.

Some advantages of the invention and the aspects thereof will be summarized and completed below:

The microtitration plate can be manufactured as a whole product in a cleanroom. There is no risk of contamination by bought-out components, as is the case if adhesive labels are used, for example.

The laser-made inscription cannot get lost or manipulated. It is resistant to aging as is the microtitration plate itself.

Contaminations of the microtitration plate due to evaporating solvents, e.g. from printing inks, are avoided. Nor is there any influence acting on the receptacle surface by an activation which requires to be made on the surface before microtitration plates made of polypropylene are imprinted.

Further, the laser-made inscription can be formed at the plate edges without any restriction. A circumferential edge will be an annoyance here, e.g. in dabber printing, which serves for sealingly positioning a sealing sheet, for example. The same is true for collars annularly protruding from the openings of the receptacles that also serve for sealingly positioning a sealing sheet.

Positionability is better than that in in-mould decoration of sheets and in dabber printing. Injection-molded inscriptions also are very accurate.

Laser-made inscriptions do not involve any heat introduction or introduce only a very small amount of heat in some cases, which is contrary to thermal transfer printing, for example. This specifically avoids warping the microtitration plate.

In the case of microtitration plates coated for the purpose of sample processing, the coat type can be applied as being visible and readable well. Coating parameters, coating data (e.g. a date for lasting stability) can be marked by applying a laser inscription on the plate at a later date.

An appropriate laser inscription system allows the user to inscribe information onto the plate at any time at a later date. They are as captive and high-contrasted as is information applied by the manufacturer of the microtitration plate.

The contrast with the laser-applied inscription can be intensified by coloring the laser-inscribable areas. The user can employ different colors of the frames or areas of the frames for different working procedures during sample processing.

The laser-made inscription allows a change in color shades from bright to dark and from dark to bright.

BRIEF DESCRIPTION OF THE SEVERAL VIEWS OF THE DRAWINGS

The invention will be described in more detail below with reference to the accompanying drawing of an embodiment. In the drawings.

DETAILED DESCRIPTION OF THE INVENTION

Figure 1:
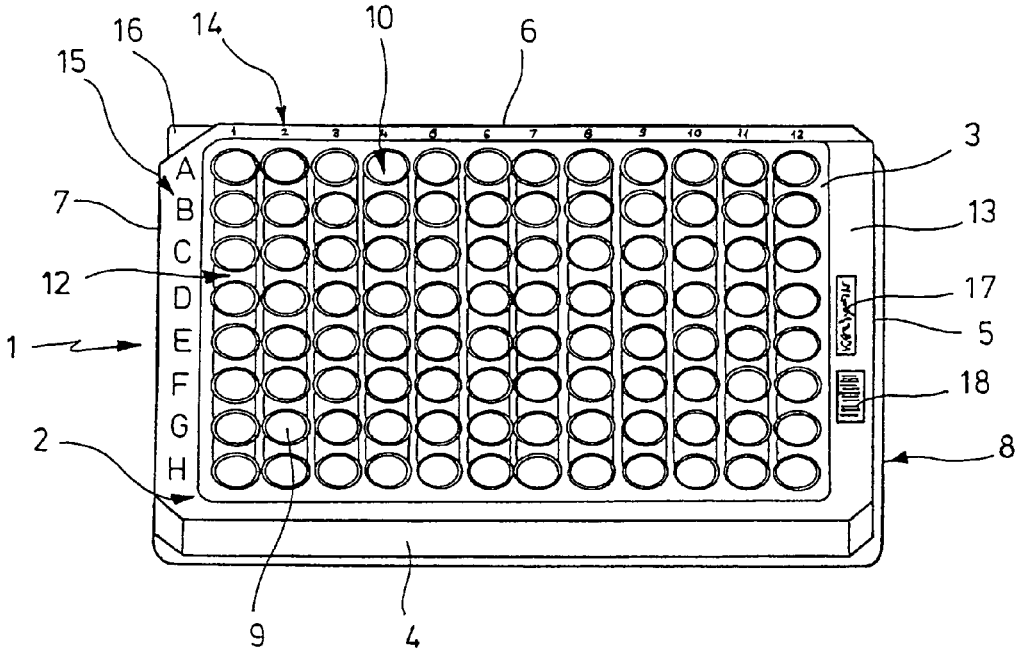
FIG. 1 shows a microtitration plate in an oblique perspective view from top.

While this invention may be embodied in many different forms, there are described in detail herein a specific preferred embodiment of the invention. This description is an exemplification of the principles of the invention and is not intended to limit the invention to the particular embodiment illustrated Referring to FIG. 1, a microtitration plate 1 comprises a frame 2 including a substantially rectangular, planar plate 3 and four side walls 4, 5, 6, 7 which are directed downwards approximately vertically from the four sides of the plate 3, and which define a jacket 8 altogether.

The plate 3 has connected thereto a multiplicity of tubularly shaped receptacles 9. The receptacles 9 are connected to the plate 3 at their upper border. They have an opening 10 each, which is accessible from the top, in the plane of the plate 3. They further have a seat 11 protruding downwards from below the plate 3 that is closed by a bottom at its base.

The receptacles 9 are arranged in a central area 12 of the plate 3 in eight rows and twelve columns. There is a total number of 96 receptacles 9.

An area 13 of the plate 3 that surrounds the central area 12 in a frame-like manner has numbers 14 (from 1 to 12) at one side next to the rows and has letters 15 (from A to H) for an identification of the receptacles 9 at one side next to the columns. The area 13 further has a position identifier 16 at the corner which is adjacent to the receptacle 9 which is marked by A1.

Another side of the frame-like area 13 has mounted thereon a manufacturer's identifier 17 concerning the manufacturer and an identifier of the plate type in the form of a barcode 18.

Figure 2:
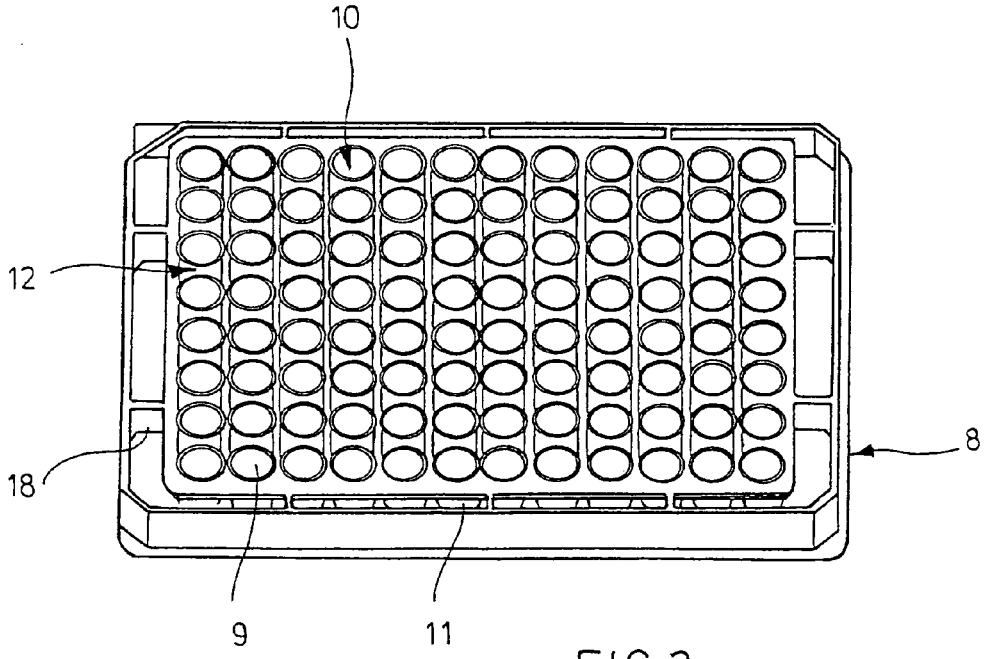
FIG. 2 shows the receptacles, the central area, the webs, and the frame of the same microtitration plate prior to injection moulding a laser-inscribable area of the frame in an oblique perspective view from top.

Referring to FIG. 2, the central area 12 with the receptacles 9, the jacket 8, and webs 18 interconnecting the central area 12 and jacket 8 are produced in a first step of manufacture. The webs 18 may be connected to receptacles 9 rather than with the central area 12. Those areas of the microtitration plate are integrally injection-molded from a plastic which cannot be inscribed by a laser and is allowed to contact the samples to be processed without causing any harm thereto (e.g. PP, PS).

In a second injection moulding step, the frame-like area 13 between the central area 12 and jacket 8 is injection molded from a laser-inscribable plastic. The laser-inscribable plastic comprises a basic material (e.g. PP, PS) and a laser additive. The additive or pigments below are employed as a laser additive:

Kaolin, chalk and aluminas (mainly a $CO_2$ laser)
Layered silicates and mica (mainly a $CO_2$ laser)
Metallic pigments ($CO_2$ laser and Nd:YAG laser)
Pearl gloss pigments ($CO_2$ laser and Nd:YAG laser)
Antimony (III) oxide (Nd:YAG laser)
Carbon black (all laser types)
Metallic oxide-coated mica pigments (e.g. Lazerflair®) (all laser types depending on the pigment type).

Finally, the above-discussed identifiers are introduced by laser-made inscription. The laser types listed up above can be used here, for example. The inscription by a laser can be made by the manufacturer or user.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A microtitration plate, comprising:

a frame (2, 8) which is made of at least one laser-inscribable plastic in at least one area (13), and a multiplicity of receptacles (9) arranged in the frame and having an opening (10) on one side of the frame (2, 8) which are made of a plastic other than the laser-inscribable plastic wherein the frame (2, 8) has a plate (2) in which the receptacles (9) are formed or to which the receptacles (9) are connected, wherein the microtitration plate has at least one laser-made inscription (14, 15) on the frame (2,8) in the at least one area (13), wherein the receptacles (9), a central area (12) of the plate (2) that is connected to the receptacles (9), a jacket (8) of the frame that surrounds the plate, and webs (18) connecting the central area (12) to the jacket (8) are made of the same plastic other than the laser-inscribable plastic and one area (13) of the frame (2, 8) that is disposed between the central area (12) of the plate (2) and the jacket (8) is made of the laser-inscribable plastic completely or at least in part, further wherein one area (13) of the plate (2) that surrounds all of the receptacles (9) in a frame-like manner is made of the laser-inscribable plastic completely or in at least one area.

2. The microtitration plate according to claim 1 wherein the plate (2) is made of the laser-inscribable plastic in at least one area (13).

3. The microtitration plate according to claim 1 wherein an upper layer of the frame (2, 8) is made of the laser-inscribable plastic completely or in at least one area.

4. The microtitration plate according to claim 1 wherein the laser-inscribable plastic is of a color other than that of areas of the frame (2, 8) that cannot be inscribed by a laser, and/or that of the receptacles (9).

5. The microtitration plate according to claim 1 which comprises a plurality of areas (13) made of a laser-inscribable plastic of different colors.

6. The microtitration plate according to claim 1 wherein the laser-inscribable plastic has an adhesive bond and/or a joint via counterdrafts and/or a latched joint with adjacent areas of the frame (2, 8) and/or the receptacles (9).

7. The microtitration plate according to claim 6 wherein the adhesive bond is a fusion of various plastics or a bond of various plastics via an adhesive substance.

8. The microtitration plate according to claim 1 wherein the laser-inscribable plastic comprises a basic material including a laser additive.

9. The microtitration plate according to claim 8 wherein the basic material essentially is the same as the plastic of frame areas which cannot be inscribed by a laser and/or the plastic of the receptacles (9).

10. The microtitration plate according to claim 8 wherein the basic material of the laser-inscribable plastic is PP or PS or another thermoplastic substance or thermoplastic elastomer.

11. The microtitration plate according to claim 1 wherein the laser-inscribable plastic is PC or PVC or another plastic which can be inscribed by a laser not including laser additives.

12. The microtitration plate according to claim 1 wherein the plastic of areas of the frame (2,8) is PP, PS, or another thermoplastic substance or thermoplastic elastomer.

13. The microtitration plate according to claim 1 wherein the receptacles (9) are made of a transparent plastic at least in part.

14. The microtitration plate according to claim 1 which has a laser-made inscription (14, 15) the color of which is different from that of areas of the frame (2, 8) and/or that of the receptacles (9) that cannot be written by a laser.

15. The microtitration plate according to claim 1 wherein the laser-made inscription is a receptacle identifier (14, 15) including a series of numbers and a series of letters for an identification of each receptacle (9) of the microtitration plate and/or a plate identifier (18) for an identification of the entire microtitration plate and/or a manufacturer's identifier (17) or position identifier (16) to mark the orientation of the microtitration plate.

16. The microtitration plate according to claim 15 which has the position identifier (16) at a corner of the frame (2, 8).

17. The microtitration plate according to claim 15 which has the series of numbers of the receptacle identifier (14, 15) at one side of an area (12) of the frame (2, 8) that surrounds a central area (12) of the frame (2, 8) in a frame-like manner and has the identifier consisting of letters at a side perpendicular thereto of the area (13) of the frame (2, 8) that surrounds the central area (12) of the frame (2, 8) in a frame-like manner.

18. The microtitration plate according to claim 15 wherein the plate identifier (18) is a line code (bar code) or a two-dimensional dot code (Dot Matrix Code).

* * * * *